US008387667B2

(12) United States Patent
Burton et al.

(10) Patent No.: US 8,387,667 B2
(45) Date of Patent: Mar. 5, 2013

(54) YARN TUFT HOLDER

(75) Inventors: Michael Winspear Burton, West Midlands (GB); Bruce Peter Hodges, Worcestershire (GB)

(73) Assignee: Brintons Carpets Limited, Worcestershire (GB)

( * ) Notice: Subject to any disclaimer, the term of this patent is extended or adjusted under 35 U.S.C. 154(b) by 180 days.

(21) Appl. No.: 12/596,899

(22) PCT Filed: Apr. 22, 2008

(86) PCT No.: PCT/GB2008/001416

§ 371 (c)(1), (2), (4) Date: Feb. 18, 2010

(87) PCT Pub. No.: WO2008/129297

PCT Pub. Date: Oct. 30, 2008

(65) Prior Publication Data

US 2010/0282357 A1 Nov. 11, 2010

Related U.S. Application Data

(63) Continuation of application No. PCT/GB2008/001416, filed on Apr. 22, 2008.

(30) Foreign Application Priority Data

Apr. 23, 2007 (GB) ..... 0707800.9

(51) Int. Cl.
*D03D 39/02* (2006.01)
*D03D 39/00* (2006.01)

(52) U.S. Cl. ..... 139/2; 139/7 A; 139/7 C; 139/7 D; 139/7 E; 139/401

(58) Field of Classification Search ..... 139/1 R, 139/2–6, 7 R, 8–10, 7 A–7 G, 21, 399–401
See application file for complete search history.

(56) References Cited

U.S. PATENT DOCUMENTS

| | | | | | |
|---|---|---|---|---|---|
| 248,669 | A | * | 10/1881 | Sackett | 28/149 |
| 1,436,619 | A | * | 11/1922 | Alvord | 139/7 D |
| 1,512,928 | A | * | 10/1924 | Hathaway et al. | 28/216 |
| 1,609,272 | A | * | 11/1926 | Davis | 139/2 |
| 1,686,331 | A | * | 10/1928 | Le Gloahec | 139/5 |
| 1,713,506 | A | * | 5/1929 | Alvord | 139/10 |
| 1,804,008 | A | * | 5/1931 | Greaves et al. | 139/2 |
| 1,817,469 | A | * | 8/1931 | Vickerman | 28/214 |
| 1,848,748 | A | * | 3/1932 | Podlysky | 28/214 |
| 1,855,810 | A | * | 4/1932 | Vickerman | 28/216 |
| 1,872,023 | A | | 8/1932 | Alvord | |
| 1,921,053 | A | * | 8/1933 | Vickerman | 28/214 |
| 1,948,835 | A | * | 2/1934 | Alvord | 139/10 |

(Continued)

FOREIGN PATENT DOCUMENTS

| | | | |
|---|---|---|---|
| GB | 389736 | A | 3/1933 |
| GB | 417136 | A | 9/1934 |

(Continued)

*Primary Examiner* — Bobby Muromoto, Jr.
(74) *Attorney, Agent, or Firm* — Sughrue Mion, PLLC

(57) ABSTRACT

A yarn tuft holder (11) for holding yarn tufts received from one or more yarn tuft inserting devices (2) prior to removal by grippers (13) of a carpet manufacturing machine, comprising a resiliently deformable comb portion (17) for receiving and holding yarn tufts and a rigid comb portion (16) disposed adjacent the resiliently deformable comb portion and for guiding grippers configured to remove yarn tufts held by the resiliently deformable comb portion. Also, a loom for making carpet, comprising one or more of the yarn tuft holders, and a method for making carpet using the loom.

17 Claims, 4 Drawing Sheets

U.S. PATENT DOCUMENTS

| | | | | | |
|---|---|---|---|---|---|
| 1,965,395 | A | * | 7/1934 | Shuttleworth | 139/2 |
| 2,075,402 | A | * | 3/1937 | Muldoon | 139/9 |
| 2,082,875 | A | * | 6/1937 | Dacey | 139/9 |
| 2,324,564 | A | * | 7/1943 | Dacey | 139/9 |
| 2,414,064 | A | * | 1/1947 | Schulz et al. | 139/47 |
| 2,505,628 | A | * | 4/1950 | Picking | 139/5 |
| 3,054,277 | A | * | 9/1962 | Broschard | 66/1 A |
| 3,092,149 | A | * | 6/1963 | Robb | 139/46 |
| 3,119,361 | A | * | 1/1964 | Nowicki | 112/80.72 |
| 3,379,222 | A | * | 4/1968 | Fleischer et al. | 139/6 |
| 3,821,543 | A | * | 6/1974 | Gelin et al. | 242/472.8 |
| 3,949,452 | A | * | 4/1976 | Henderson | 28/299 |
| 3,963,057 | A | * | 6/1976 | Dewhirst | 139/2 |
| 3,963,058 | A | * | 6/1976 | Dewhirst | 139/2 |
| 4,978,008 | A | * | 12/1990 | Dalbo et al. | 206/574 |
| 5,743,306 | A | * | 4/1998 | Stewart et al. | 139/7 A |
| 6,701,970 | B2 | * | 3/2004 | Burton | 139/7 A |
| 6,820,656 | B2 | * | 11/2004 | Burton | 139/7 A |
| 6,994,121 | B2 | * | 2/2006 | Burton | 139/7 A |
| 7,044,172 | B2 | * | 5/2006 | Stewart | 139/7 A |
| 2003/0145897 | A1 | * | 8/2003 | Burton | 139/37 |
| 2003/0150505 | A1 | * | 8/2003 | Burton | 139/7 A |
| 2004/0099326 | A1 | * | 5/2004 | Burton | 139/116.5 |
| 2010/0200103 | A1 | * | 8/2010 | Burton | 139/8 |

FOREIGN PATENT DOCUMENTS

| | | | |
|---|---|---|---|
| GB | 1 597 134 | A | 9/1981 |
| GB | 2 227 499 | A | 8/1990 |
| WO | 95/31594 | A1 | 11/1995 |

* cited by examiner

YARN TUFT HOLDER

FIELD OF THE INVENTION

The invention relates to a yarn tuft holder. The invention relates, in particular, to a yarn tuft holder for an Axminster loom for making Axminster carpet.

On a gripper Jacquard Axminster loom each weaving point includes a yarn carrier which is normally fed by eight, or sometimes sixteen, yarns usually of different colour and the Jacquard mechanism moves the carrier to bring a selected yarn to the yarn selection position. A gripper moves towards the carrier, grips the yarn at the yarn selection position then relative movement apart of the gripper and the carrier pulls a predetermined length of yarn from the carrier.

The yarn is then cut to form a tuft and moved by the gripper to the weaving point. The tuft carried by the gripper is of the appropriate colour for the tuft to be supplied to the next row of carpet to be woven.

In spool Axminster looms a separate spool is provided for each row of the pattern repeat and each spool has a separate yarn winding for each weaving point along each row.

BACKGROUND TO THE INVENTION

In both the Jacquard and spool Axminster looms a row of tufts for a complete row of the carpet is created simultaneously and transferred to the weaving point at which they are woven into a backing to produce the carpet.

A different approach to yarn tuft formation is described in WO 95/31594. Tufts of yarn to form a row of the carpet are produced by first loading yarn tufts into a yarn tuft holder by traversing the tuft holder stepwise through a sequence of loading positions so as to temporarily present predefined tuft retention sites of the tuft holder to each of a plurality of stationary tuft forming units. At each loading position one or more tufts are loaded into the sites by the tuft forming units until the tuft holder is loaded with tufts for a complete row of the carpet. The tufts are then transferred from the tuft holder to the weaving points simultaneously by means of grippers. Since the grippers do not perform the tuft formation, tuft formation can take place at the same time as the weaving operation and thus tuft formation can take place substantially continuously throughout the operation of the loom. This is to be contrasted with the conventional spool or gripper type looms where tuft formation takes place over only about half of each weaving cycle.

A yet further approach to yarn tuft formation is described in WO 02/00978. The loom includes one or more tuft forming units each of which includes a yarn selector wheel which typically holds 12 or 24 yarns of different colour. A motor drives the yarn selector wheel into one of a number of angularly discrete positions to select yarn of a predetermined colour. As the or each tuft forming unit traverses the loom relative to a stationary yarn tuft holder, tufts of predetermined colour are placed in tuft retention sites of the tuft holder. When the tuft holder is loaded with tufts for a complete row of the carpet, the tufts are transferred from the tuft holder to the weaving points simultaneously by means of grippers.

The yarn tuft holders of the prior art may take many different forms for securely holding each tuft. The tuft holder may be rigid and the profile of each slot defining a tuft retention site may be shaped such that the inherent elasticity of the tuft holds the tuft at the bottom of the slot when pressed therein. Alternatively, one or both opposing sides of each slot may be formed of a resilient material capable of gripping a tuft presented into the slot. Yet further, the sides of each slot may be rigid and a resilient clip may be provided to hold the tuft in place.

A problem associated with the yarn tuft holders of the prior art is that the position of the yarn tufts in the holder, and transfer of the tufts therefrom by the grippers, cannot always be accurately controlled. Unless all of the tufts are positioned correctly in the loaded tuft holder and all of the grippers can securely transport all of the tufts from the tuft holder to the weaving points, the grippers may transfer some of the tufts to the weaving points incorrectly or fail to transfer them at all. This can lead to a requirement for longer tufts so that these can be more readily gripped by the grippers resulting in increased yarn wastage. Any transfer failures can lead to downtime of the loom, and/or necessitate post production rectification of any flaws in the carpet.

There is therefore a need in the art for an improved yarn tuft holder which alleviates the above problems.

SUMMARY OF THE INVENTION

According to a first aspect of the invention there is provided a yarn tuft holder for holding yarn tufts received from one or more yarn tuft inserting devices prior to removal by grippers of a carpet manufacturing machine, the holder comprising a resiliently deformable comb portion for receiving and holding yarn tufts, and a rigid comb portion disposed adjacent the resiliently deformable comb portion and for guiding grippers configured to remove yarn tufts held by the resiliently deformable comb portion. The invention provides improved control over the yarn tufts and the grippers leading to more reliable transfer of the yarn tufts to their weaving positions.

According to a second aspect of the invention there is provided a carpet manufacturing machine, comprising one or more yarn tuft holders in accordance with the first aspect. The carpet manufacturing machine may be similar to that described in WO 95/31594 or WO 02/00978, or any other suitable carpet manufacturing machine.

According to a third aspect of the invention there is provided a method for making carpet using a carpet manufacturing machine in accordance with the second aspect, comprising the steps of inserting yarn tufts into the resiliently deformable comb portion of one of the yarn tuft holders, guiding grippers using the rigid comb portion of said yarn tuft holder during removal of said yarn tufts by said grippers from said yarn tuft holder, and securing the removed yarn tufts into a backing.

In a preferred exemplary embodiment the resiliently deformable comb portion is of plastics material and formed having an array of teeth separated by slots. The teeth are shaped so as to define a stem portion and a head portion wider than the stem portion. The length and form of the stem defines the degree of flexibility of each tooth; a shorter, fatter stem producing a stiffer tooth. The head portion has a cut out for forming a cavity with an adjacent tooth, the cavity being adapted for receiving and holding a yarn tuft at a yarn tuft retention site. A dimension of the cavity is suitable for firmly holding the yarn tuft and yet enabling removal of the yarn tuft by the grippers easily. A lip extends from the top of the cavity towards the adjacent tooth to help keep the tuft in position. The head portion is tapered towards the top so that the tooth does not undergo a large deflection as the yarn tuft is loaded and as the inserting device is retracted. This feature is particularly beneficial where the yarn tuft holder of the invention is implemented in a loom where the yarn tuft inserting device (s) continuously traverse across the length of the stationary yarn tuft holder loading tufts therein.

In alternative exemplary embodiments, the geometry of the tooth form can be altered to allow the plastics comb to accommodate a number of operational variables such as speed of loading of the tufts, speed of traverse of the inserting device (s), form of the yarn tuft inserting device(s), and yarn tuft thickness. Thicker yarn tufts may be accommodated by increasing the cavity dimension. It may also be of benefit to include a platform extending from the bottom of the cavity towards an adjacent tooth. The platform may extend to beneath the head portion of the adjacent tooth. A serrated edge on at least one side wall of the cavity could be used to provide additional grip on the yarn tuft. A channel may be formed extending longitudinally across the resiliently deformable comb portion to define two laterally spaced combs that can retain each of the yarn tufts at two spaced positions along the length of each tuft.

In the preferred or alternative exemplary embodiments, slots formed in the rigid comb portion align with the slots formed in the resiliently deformable comb portion. A plurality of the resiliently deformable comb portions are removably connected to the rigid comb portion. Manufacturing the resiliently deformable comb portions as shorter sections than the rigid comb portion provides the benefits of reduced tooling costs, small pitch variations due to material shrinkage in the case that the sections are moulded, and also makes replacement of the sections easier as they become worn or damaged. Each of the plurality of resiliently deformable comb portions is aligned with the rigid comb portion by means of mating projections and recesses to aid pitch control. The number of yarn tufts held in each resiliently deformable comb portion can be 20, but any suitable number may be used, from about 5 to 500, for example 25 or 30.

BRIEF DESCRIPTION OF THE DRAWINGS

Examples of the present invention will now be described in detail with reference to the accompanying drawings, in which.

DETAILED DESCRIPTION

Figure 1:
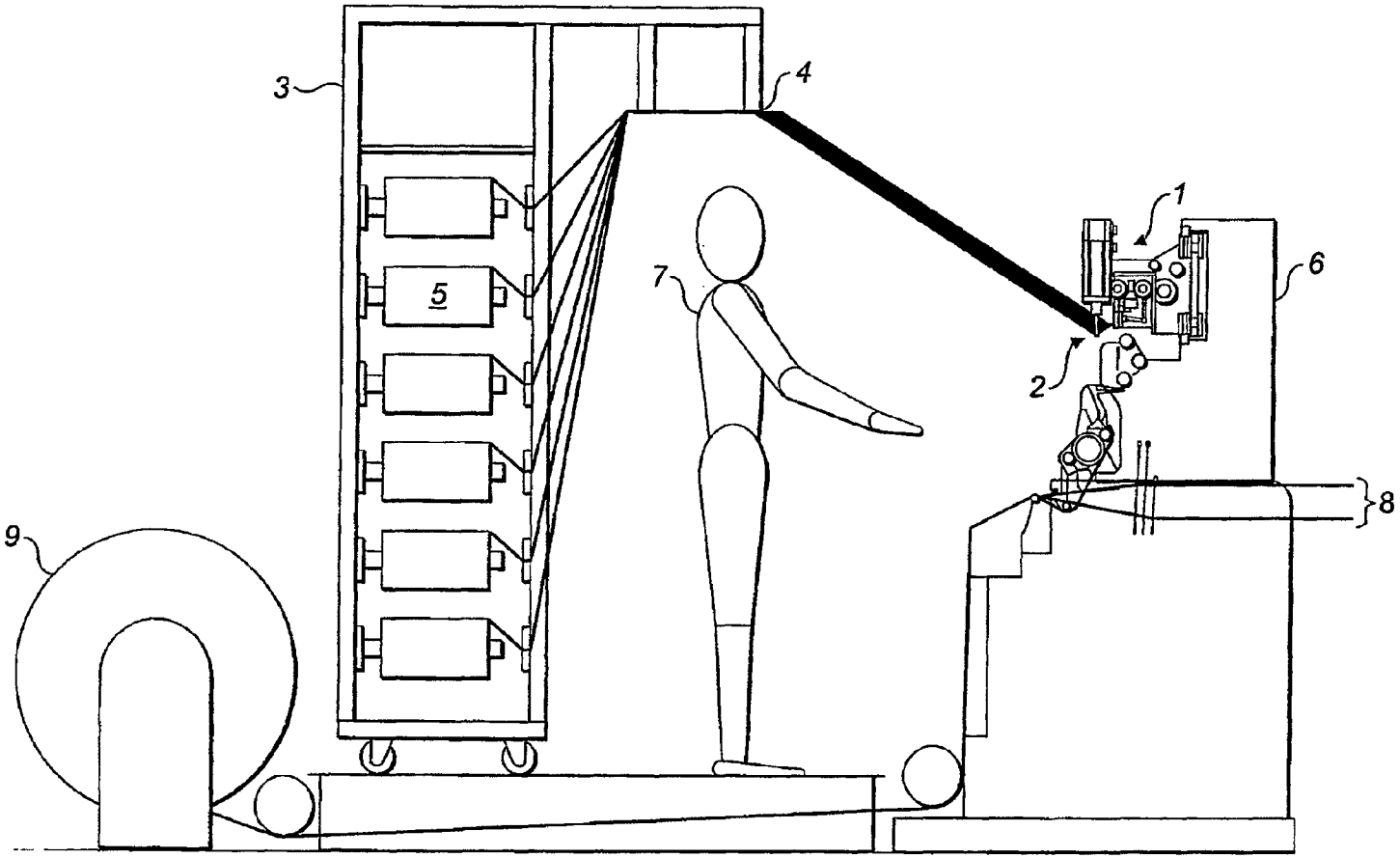
FIG. 1 is a partly sectioned side elevation of the loom.
Figure 2:
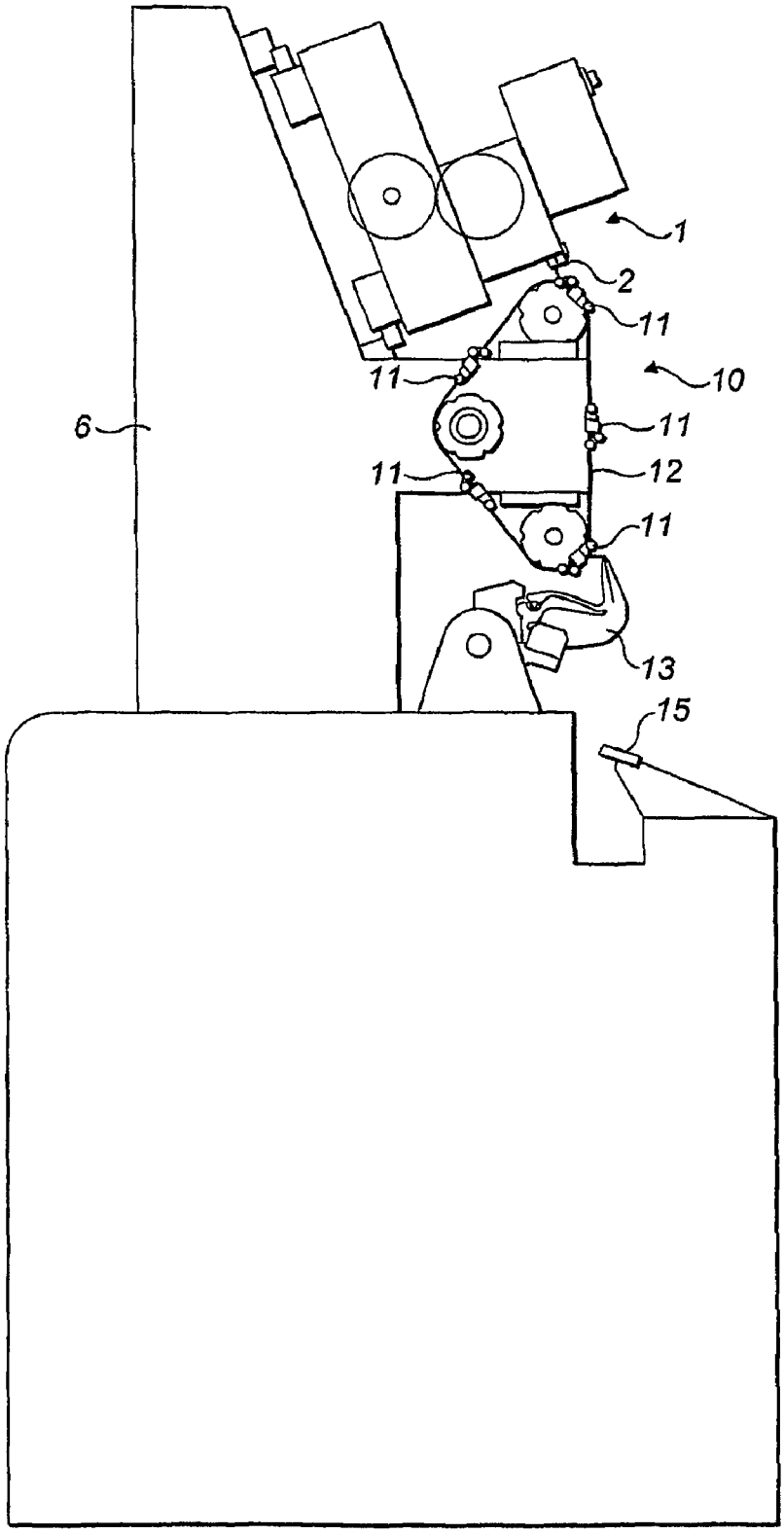
FIG. 2 is a schematic side elevation of the weaving section of the loom.

The carpet weaving loom shown in FIGS. 1 and 2 includes one or more tuft forming units 1 each of which supplies yarn tufts to one or more different weaving points and each of which includes a yarn inserting device 2, a movable creel 3 for holding supplies of yarn, and guides 4 to guide yarn from a supply 5 on the creel 3 to the or each tuft forming unit 1. The creel 3 is located in the front of the loom and behind the weavers position 7. This is on the opposite side of the loom from the warp beam (not shown) from which the warp threads 8 are provided. Alternatively, the creel 3 may be located above a remainder of the loom 6. The completed carpet is collected on a roll 9.

The loom includes a yarn tuft transfer system 10 including five yarn tuft holders 11 mounted on a belt 12. The belt 12 is arranged for movement around a closed loop to sequentially present each of the yarn tuft holders 11 to the yarn tuft inserting devices 2. A set of grippers 13 are configured to unload the lowermost yarn tuft holder 11 that is filled with tufts and transfer these to their respective weaving point 15.

Figure 5:
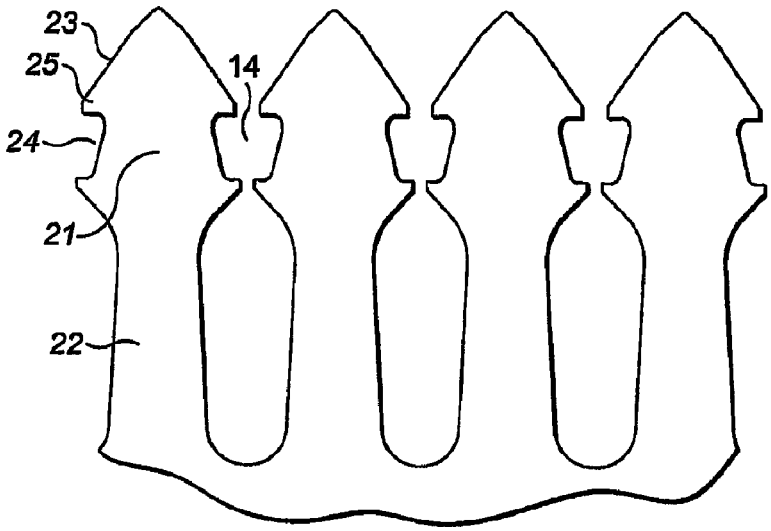
FIG. 5 is a schematic view of the teeth of the resiliently deformable comb portion.

In the preferred embodiment shown with reference to FIGS. 1 and 2, as the tuft forming units 1 traverse across the loom, tufts are placed by inserting devices 2 in tuft retention sites 14 (shown in FIG. 5) formed along the top edge of the yarn tuft holder 11. When all of the tuft retention sites 14 have been loaded, the yarn tuft holder 11 rotates clockwise (as seen in FIG. 2) to move the loaded tuft holder 11 towards the lowermost position and to move an empty yarn tuft holder 11 towards the uppermost position. The inserting devices 2 of the tuft forming units 1 then load tufts into the uppermost yarn tuft holder as they traverse back across the loom in the opposite direction.

The grippers 13 move upwards, counter-clockwise as seen in FIG. 2, with their beaks open and then close to grip all of the tufts held by the lowermost yarn tuft holder 11. The grippers 13 then rotate in the opposite direction to move the tufts to the weaving point 15 where the tufts are woven into the carpet and the grippers 13 open to release the tufts. The beat up reeds and weft insertion mechanism have been omitted from FIG. 2 for clarity but are entirely conventional and similar to those used on the conventional gripper Axminster carpet looms.

Figure 3:
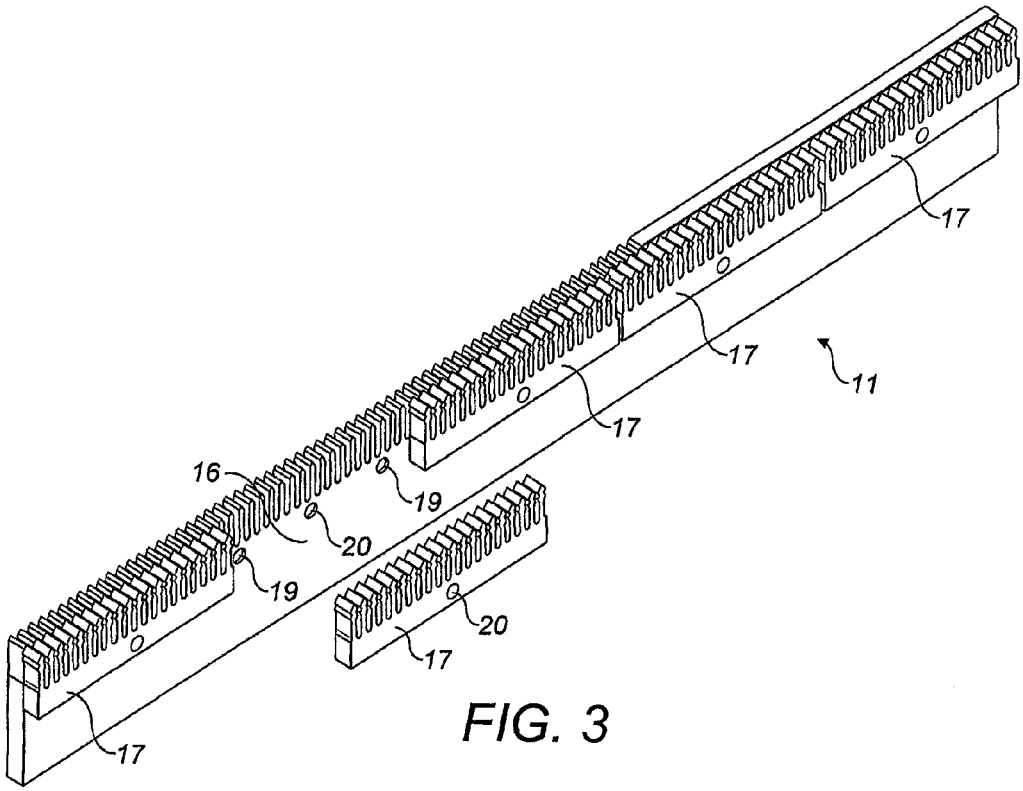
FIG. 3 is a partly exploded isometric view of the yarn tuft holder.
Figure 4:
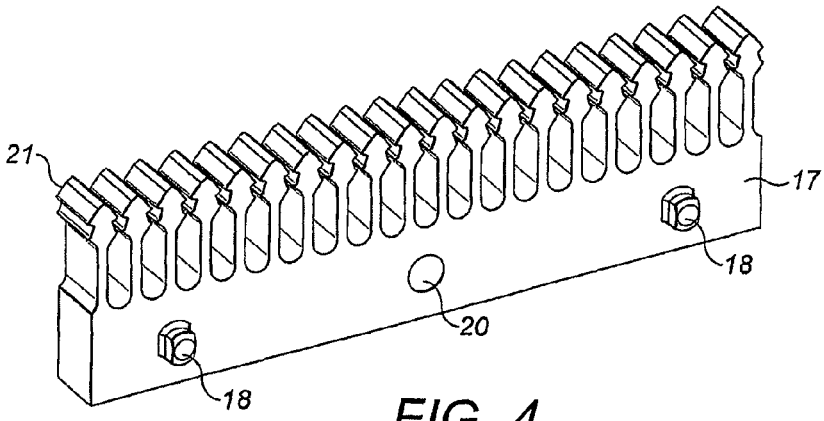
FIG. 4 is an isometric view of one of the resiliently deformable comb portions according to a first preferred embodiment.

The yarn tuft holder 11 is shown in detail in FIG. 3 and comprises a rigid comb portion 16 and a plurality of resiliently deformable comb portions 17. In the preferred embodiment the rigid comb portion 16 is made of metal and the resiliently deformable comb portions 17 are made of plastics material. The resiliently deformable comb portions 17 receive the yarn tufts and hold them securely until the grippers 13 remove them. The rigid comb portion acts as a guide for the grippers 13 to centre them before they remove the yarn tufts. The rigid comb portion also provides a degree of control of the yarn tuft ends held in the resiliently deformable comb portions 17. Accurate pitch control of the yarn tufts held in the yarn tuft holder 11 is attained by using the plurality of resiliently deformable comb portions 17, shorter than the rigid comb portion 16. This is also attained by the alignment of projections 18 extending from the resiliently deformable comb portions 17 located in recesses 19 formed in the rigid comb portion 16. One or more screws, or the like, are employed for fixing the resiliently deformable comb portions 17 to the rigid comb portion 16 at position 20. This allows for easy removal and replacement of the resiliently deformable comb portions 17 from the rigid comb portion 16.

The number of tuft retention sites 14 in each resiliently deformable comb portion is preferably 20, but could easily be adapted to 25, 30 or any other suitable number. Manufacturing the resiliently deformable comb portion in small sections provides the benefits of reduced tooling costs, smaller pitch variations due to material shrinkage if the part is moulded, and easy replacement when the part is worn or damaged. The form of the teeth 21 of the resiliently deformable comb portions 17 will now be described with reference to FIG. 5. Each tooth of the resiliently deformable comb portions 17 has a flexible stem 22 and a head 23 wider than the stem 22. The degree of flexibility of the comb is defined by the length and form of the stem 22; a shorter, fatter stem 22 producing a stiffer tooth 21. Each head portion 23 has a cut out 24 forming a cavity with an adjacent tooth 21, the cavity defining the tuft retention site 14. A dimension of the cavity is suitable for firmly holding the yarn tuft and yet enabling removal of the yarn tuft by the grippers 13 easily. A lip 25 extends from the top of the cavity towards the adjacent tooth 21 to help keep the tuft in position. The head portion 23 is tapered towards the top so that the tooth 21 does not undergo a large deflection as the yarn tuft is loaded and the inserting device 2 is retracted. This feature allows the yarn tuft insertion to be completed continuously as the yarn tuft inserting device 2 moves across the length of the yarn tuft holder 11 loading tufts therein.

Whilst the preferred embodiment of the invention has been described with reference to a gripper Axminster loom similar to that described in WO 02/00978, it will be appreciated that the yarn tuft holder of the invention is equally suitable for the loom described in WO 95/31594, where the yarn tuft holder moves relative to stationary tuft inserting devices. The design of the yarn tuft holder in accordance with the invention allows continuous movement between the tuft inserting device 2 and the yarn tuft holder 11, although this movement may be intermittent. Alternatively, the yarn tuft holder 11 may be stationary and hold yarn tufts inserted by the yarn tuft inserting devices, prior to removal by grippers for a weaving operation.

Figure 6:
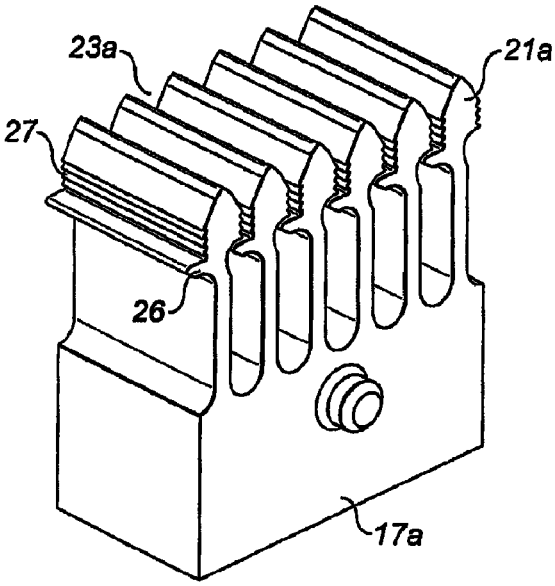
FIG. 6 is an isometric view of one of the resiliently deformable comb portions according to a second embodiment.

A second, alternative exemplary embodiment of the yarn tuft holder will now be described with reference to FIG. 6. The yarn tuft holder 11 of the second embodiment differs only from the first, preferred embodiment in features of the teeth 21 of the resiliently deformable comb portions 17. In the second embodiment, the resiliently deformable comb portion 17*a* includes a platform 26 extending from the bottom of the cavity towards the adjacent tooth 21*a*. Platform 26 may extend to beneath the head portion 23*a* of the adjacent tooth 21*a*. A serrated edge 27 is formed on at least one side wall of the cavity to provide additional grip on the yarn tuft when held in the yarn tuft retention sites 14. It will be appreciated by those skilled in the art that the features of the second embodiment may be employed together or separately in the first, preferred embodiment.

Figure 7:
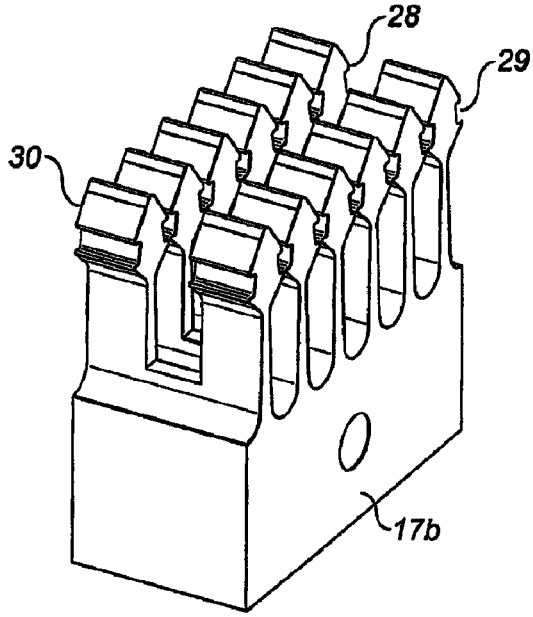
FIG. 7 is an isometric view of one of the resiliently deformable comb portions according to a third embodiment.

A third embodiment of the invention will now be described with reference to FIG. 7 which shows the further alternative resiliently deformable comb portion 17*b*. In the third embodiment, a channel 28 is formed extending longitudinally across resiliently deformable comb portion 17*b* to define two laterally spaced combs 29, 30 that can retain each of the yarn tufts at two spaced positions along the length of each tuft. Alternatively, a plurality of such channels could be employed so increasing the number of retaining positions for each tuft.

The invention claimed is:

1. A yarn tuft holder for holding cut yarn tufts received from one or more yarn tuft inserting devices prior to removal by grippers of a carpet manufacturing machine comprising:

a resiliently deformable comb portion for receiving and holding the cut yarn tufts; and a rigid comb portion removably attached to the resiliently deformable comb portion, wherein the rigid comb portion comprises at least a first tooth, a second tooth, and a space formed between the first tooth and the second tooth, and wherein the space guides a portion of a gripper inserted into the space, the portion of the gripper inserted into the space being configured to remove the cut yarn tufts held by the resiliently deformable comb portion.

2. A yarn tuft holder according to claim 1, wherein slots of the resiliently deformable comb portion define yarn tuft retention sites.

3. A yarn tuft holder according to claim 2, wherein teeth between the slots formed in the resiliently deformable comb portion are shaped so as to define a stem portion and a head portion wider than the stem portion.

4. A yarn tuft holder according to claim 3, wherein the head portion has a cut out for forming a cavity with an adjacent tooth, the cavity being adapted for receiving and holding a yarn tuft.

5. A yarn tuft holder according to claim 4, wherein a lip extends from the top of the cavity towards the adjacent tooth.

6. A yarn tuft holder according to claim 4, wherein a platform extends from the bottom of the cavity towards the adjacent tooth.

7. A yarn tuft holder according to claim 5, wherein the platform extends to beneath the head portion of the adjacent tooth.

8. A yarn tuft holder according to claim 4, wherein at least one side of the cavity has a serrated wall.

9. A yarn tuft holder according to claim 3, wherein the head portion is tapered towards the top.

10. A yarn tuft holder according to claim 2, wherein slots formed in the rigid comb portion align with the slots formed in the resiliently deformable comb portion.

11. A yarn tuft holder according to claim 1, wherein a channel extends longitudinally across the resiliently deformable comb portion to define two laterally spaced combs.

12. A yarn tuft holder according to claim 1, wherein a plurality of the resiliently deformable comb portions are removably connected to the rigid comb portion.

13. A yarn tuft holder according to claim 12, wherein each of the plurality of the resiliently deformable comb portions has between 5 and 500 teeth, preferably 20, 25 or 30 teeth.

14. A yarn tuft holder according to claim 12, wherein each of the plurality of the resiliently deformable comb portions has one or more locating projections for aligning with recesses formed in the rigid comb portion.

15. A carpet manufacturing machine, comprising one or more yarn tuft holders in accordance with claim 1.

16. A loom according to claim 15, wherein each yarn tuft holder is adapted to move relative to one or more yarn tuft inserting devices.

17. A method for making carpet using a carpet manufacturing machine comprising one or more yarn tuft holders, comprising a resiliently deformable comb portion, and a rigid comb portion comprises at least a first tooth, a second tooth, and a space formed between the first tooth and the second tooth, the rigid comb portion removably attached to the resiliently deformable comb portion, the method comprising:

inserting yarn tufts into the resiliently deformable comb portion of one of the yarn tuft holders;

inserting a gripper into the space of the rigid comb portion;

guiding, using the space of the rigid comb portion of said yarn tuft holder, the gripper to the tufts of yarn;

removing said yarn tufts from said yarn tuft holder by said gripper; and securing the removed yarn tufts into a backing.

* * * * *